US005538050A

United States Patent [19]

Galdon

[11] Patent Number: 5,538,050

[45] Date of Patent: Jul. 23, 1996

[54] PASTRY BAG SUPPORTING DEVICE AND METHOD OF USING THE SAME

[76] Inventor: Kevin Galdon, 435 Roycroft Blvd., Snyder, N.Y. 14226

[21] Appl. No.: 337,053

[22] Filed: Nov. 10, 1994

[51] Int. Cl.[6] ..... B65B 1/04; B65B 3/00

[52] U.S. Cl. ..... 141/10; 141/316; 141/369; 141/391; 248/95; 248/99; 220/401; 383/33; 99/426

[58] Field of Search ..... 141/10, 18, 89, 141/314–317, 332, 340, 341, 342, 369, 375, 378, 379, 390, 391; 248/94, 95, 97, 99–101; 206/423; 220/485, 490, 401, 404; 215/11.3, 11.1; 383/33; 222/83, 105; 99/426

[56] References Cited

U.S. PATENT DOCUMENTS

| | | | |
|---|---|---|---|
| 2,259,866 | 10/1941 | Stokes | 248/95 |
| 3,424,076 | 1/1969 | Bernatz et al. | 99/426 |
| 4,250,664 | 2/1981 | Remke | 206/423 |
| 4,838,451 | 6/1989 | Arkell et al. | 220/401 |
| 5,244,095 | 9/1993 | DeVoe | 206/575 |

*Primary Examiner*—Henry J. Recla
*Assistant Examiner*—Steven O. Douglas
*Attorney, Agent, or Firm*—Hodgson, Russ, Andrews, Woods & Goodyear

[57] ABSTRACT

A pastry bag supporting device for facilitating the filling, cleaning, drying or storing of pastry bags. Also, an assembly comprising the pastry bag supporting device, a pastry bag positioned therewith, and a support system; and methods for using the pastry bag supporting device or the assembly.

23 Claims, 10 Drawing Sheets

PASTRY BAG SUPPORTING DEVICE AND METHOD OF USING THE SAME

BACKGROUND OF THE INVENTION

1. Field of the Invention

The present invention generally relates to a support system particularly useful in commercial food preparation. More particularly, the present invention is directed to a supporting device which provides a framework for filling a pastry bag with foodstuff to be dispensed, and also facilitates cleaning and drying and storing of the pastry bag after use.

2. Background of the Art

Pastry bags, of the general type with which the present invention is concerned, are flexible, collapsible and tapered cones comprised of paper or fabric having a large filling opening at one end through which the foodstuff is introduced, and a relatively small opening at its other end through which the foodstuff is dispensed ("the dispensing tip"). Pastry bags have been used by chefs and bakers to dispense foodstuffs with great precision and ornate creativity to fill and/or decorate many forms of edible delectibles.

As practiced by those in the art, to use a pastry bag the user fills the bag, closes the bag, dispenses the food stuff, and cleans the bag for reuse after the contents of the bag have been dispensed. Typically, filling a pastry bag involves having someone assist by holding open the filling opening of the bag while the user fills the bag with a foodstuff that is sufficiently viscous to hold its shape and not substantially leak out of the dispensing tip. The filling opening of the bag is then closed by clipping, folding or twisting the bag adjacent to the filling opening. The foodstuff may then be dispensed through any one of a variety of sizes and shapes of decorating tips inserted or attached to the dispensing tip of the bag. Cleaning the bag for reuse involves either holding the bag open while the interior is washed out, or turning the bag inside out and then proceeding with cleaning.

The process of using a pastry bag, as described above, is not without drawbacks. For example, since pastry bag filling openings tend to be small and therefore difficult for the user or user's assistant to hold completely open, filling the bag with the desirable foodstuff often results in some of the foodstuff being deposited in unintended locations, such as on the user's or assistant's clothing, on the floor, or on the work surface. Such misplacement wastes the foodstuff, as well as requires unnecessary and time consuming cleanups. Further, foodstuff deposited on the outside of the bag during filling may affect the efficiency of closing the bag for use.

After using the pastry bag, it is important because of sanitary and culinary reasons to thoroughly cleanse the bag for reuse. More often than not, this is a cumbersome process. Cleaning the interior of the bag by holding the bag open is difficult in terms of handling the bag, and removing all of the contents. Cleaning the bag by first turning it inside-out ("inverting" the bag) results in depositing of foodstuff on the cleaner, as well as causing wear and tear on the bag from inverting. Additionally, once a bag is washed it takes hours or days to dry because the bag is so flimsy that it folds over itself thereby trapping moisture, and possibly food left from poor cleansing, inside the bag which could then allow for growth of mold or bacteria.

Thus, there exists a need in the art for a framework structure or supporting device capable of securely and conveniently holding a pastry bag to facilitate filling, cleaning, drying, and storing of the pastry bag.

SUMMARY OF THE INVENTION

It is an object of the present invention to provide a pastry bag supporting device comprising a framework having a plurality of vertically spaced apart rings which differ in diameter and thereby correspond to the conical shape of a pastry bag.

It is another object of the present invention to provide a pastry bag supporting device capable of securely and conveniently holding a pastry bag open, without the assistance of an additional person, thereby facilitating filling of the bag with foodstuff and minimizing unnecessary spillage.

It is another object of the present invention to provide a pastry bag supporting device capable of securely and conveniently holding a pastry bag to facilitate manual washing or cleansing in a conventional dishwasher.

It is another object of the present invention to provide a pastry bag supporting device capable of securely and conveniently holding a pastry bag to facilitate drying of a washed or cleansed bag.

It is another object of the present invention to provide a pastry bag supporting device capable of securely and conveniently holding a pastry bag to facilitate storage of the bag during use, or for future use.

It is another object of the present invention to provide a pastry bag supporting device that may be conveniently secured to a work surface.

It is another object of the present invention to provide a pastry bag supporting device system, comprising one or more supporting devices and accessories capable of securely and conveniently holding one or more pastry bags to a work surface.

It is another object of the present invention to provide a pastry bag supporting device that may be constructed entirely of corrosion-resistant materials.

It is another object of the present invention to provide a pastry bag supporting device that is of relatively simple construction and thereby inexpensive to produce.

The above and other objects, features, and advantages of the present invention will be apparent in the following of the Best Mode for Carrying Out the Invention when read in conjunction with the accompanying drawings in which reference numerals denote the same or similar parts throughout the several views.

BEST MODE FOR CARRYING OUT THE INVENTION

The embodiment of the invention disclosed herein is the best mode contemplated by the inventor for carrying out the invention in a working environment, although it should be understood that various modifications can be accomplished within the parameters of the scope of the present invention.

Figure 1:
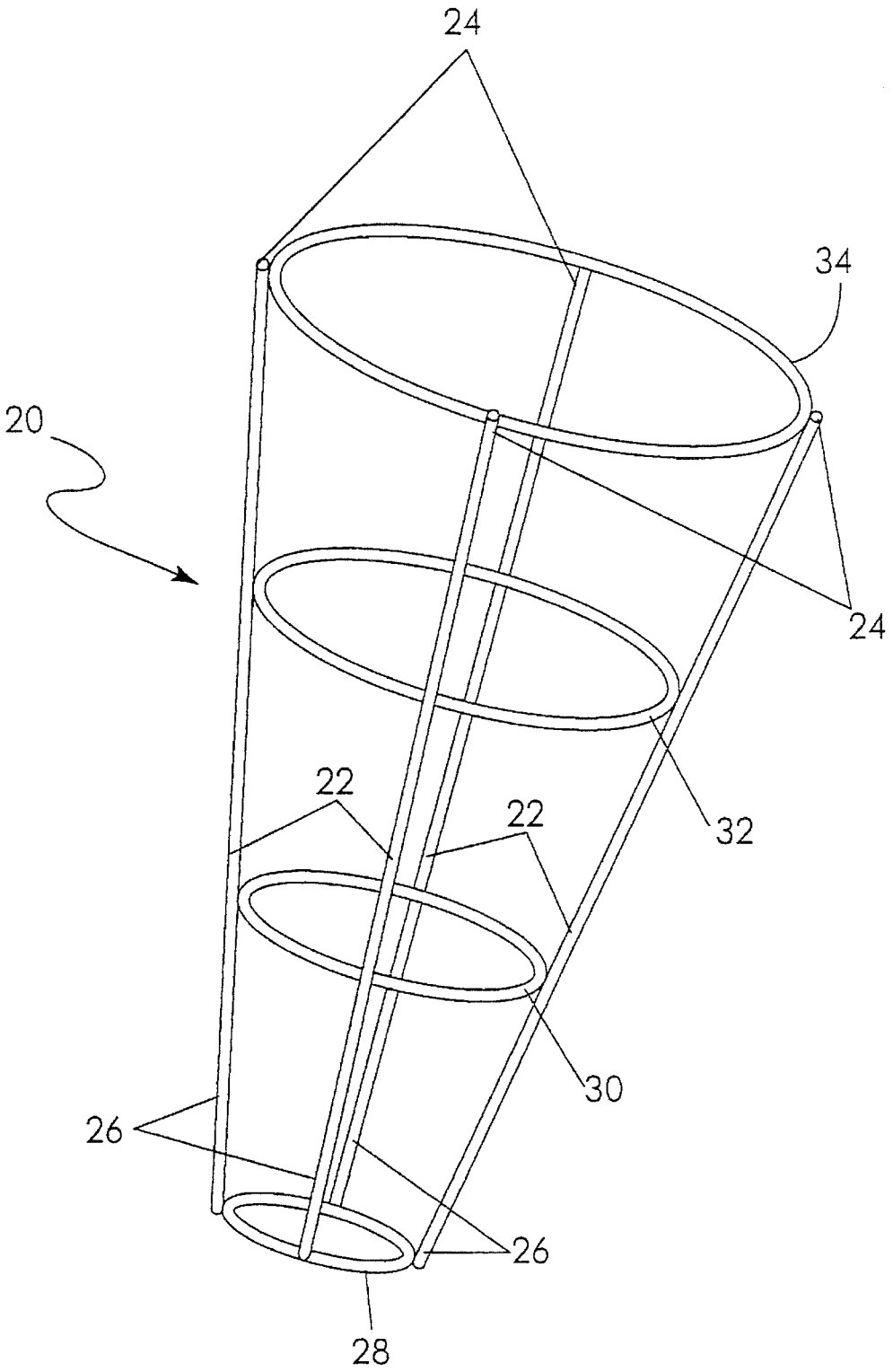
FIG. 1 is a perspective view of the pastry bag supporting device.

Referring to FIG. 1, there is illustrated generally in perspective view a pastry bag supporting device 20 having a plurality of vertically elongated rods 22 having upper ends 24 and lower ends 26. Although at least three vertical rods should be utilized to give the pastry bag supporting device a sturdy framework, four or more rods may be utilized.

Figure 2:
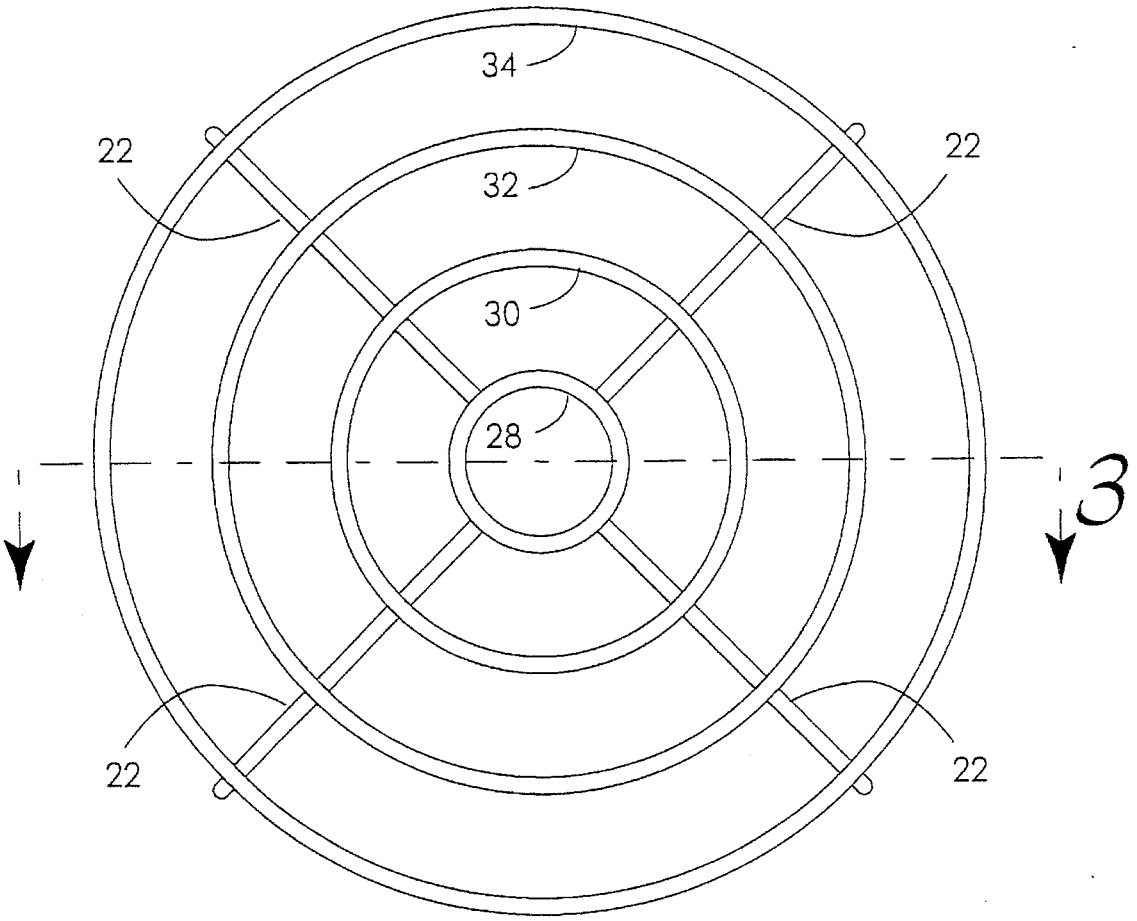
FIG. 2 is a top plan view of the pastry bag supporting device.

In an operating arrangement, the rods are preferably positioned in spaced relation in forming a tapered structure in the pattern of a cone to correspond to the shape of a pastry bag. As viewed in FIG. 2 and FIG. 3, section taken on line 3—3 of FIG. 2, holding the rods in spaced relation are a plurality of vertically spaced ring members 28, 30, 32, and 34. The ring members 28, 30, 32, and 34 are successfully smaller in diameter with ring member 34 being indicated as being the largest one, and ring member 28 being indicated as being the smallest one. Thus, the plurality of ring members have diameters which differ with respect to each other, but correspond to the decreasing concentric dimensions of a pastry bag. Although at least three ring members should be utilized to give the pastry bag supporting device a sturdy framework, four or more ring members may be utilized.

Ring members 28, 30, 32, and 34 are welded, molded, or otherwise secured to rods 22 to stabilize the rods and maintain the preferred cone pattern of the structure of pastry bag supporting device 20. The detailed relationship between ring members and rods is not critical to the invention, insofar as to whether they be manufactured as separate components or an integral body portion comprising pastry bag supporting device 20, or methods of fusion or fabrication thereof. Therefore, it must be expressly understood that pastry bag supporting device 20 may be fabricated with methods now known in the art, or later devised, without departing from the spirit or the scope of the invention.

The components, or integral body portion of pastry bag supporting device 20 may be formed from resilient, corrosion-resistant, and easily cleaned materials such as plastic, stainless steel wire, metal wire, nylon rod, or the like which can be fabricated into a framework structure corresponding to the conical shape of a pastry bag; thereby achieving the required structural integrity and providing resistance to corrosion when used to clean pastry bags by manual washing or in a conventional dishwasher. Further, the material used for pastry bag supporting device 20 should be, in addition to having rigidity proper for the framework purposes, smooth or coated with a material which provides for smooth transition of a pastry bag slipped into or over the material. In that regard, it is also desirable for pastry bag supporting device 20 to be free from burrs or sharp edges to avoid snagging of the pastry bag when using it in conjunction with pastry bag supporting device 20. As the specific character of the material does not in and of itself constitute the subject matter of the instant invention, it should be apparent to those skilled in the art that a wide latitude of choice can be exercised in selecting a material suitable for formation and/or fabrication of pastry bag supporting device 20.

The dimensions of pastry bag supporting device 20 are chosen so that a standard size pastry bag may be either slipped into pastry bag supporting device 20 so that the dispensing tip of the bag fits snugly into the smallest ring member (such as ring member 28) and so that the filling opening of the pastry bag may be folded over and around the any larger ring member (such as ring member 34 or 32; depending on the size of the bag used) and clipped, or otherwise secured to the larger ring member to maintain the pastry bag in an open and fixed position for filling purposes; yet allow for pastry bag supporting device to be inserted into the pastry bag to snugly receive and thereby maintain the bag in a fixed and open position for cleaning and drying purposes. Because a conventional assortment of pastry bags used by those skilled in the art include pastry bags which differ in the size of filling and dispensing openings, as well as overall length and width, it will be appreciated, of course, that pastry bag supporting device 20 dimensions given in the following illustration, and others which are subsequently given herein, are merely for purposes of explanation and illustration, and are not intended to limit the invention in any way.

In a preferred construction, ⅛ inch stainless steel rod is used to fabricate pastry bag supporting device 20. Ring member 34, in having the largest diameter of the ring members, is formed as having a diameter of about 7.5 inches. The diameters of the remaining ring members 32, 30, and 28 are formed to be approximately 5 inches, 3 inches, and 1.5 inches, respectively. In continuing this illustration of a preferred construction, the distance comprising the position of the vertically spaced ring members in spaced relationship to one another and in conjunction with the rods are 3⅛ inches between ring member 28 and ring member 30, 4⅛ inches between ring member 30 and ring member 32, and 5⅛ inches between ring member 32 and ring member 34. It is understood that dimensions as to the length of the rods, the diameters of the ring members, and the distance comprising the position of vertically spaced ring members in spaced relation to one another and in conjunction with the rods may be chosen to be relative to the size of conventional pastry bag used. For example, Table 1 illustrates some conventional size pastry bags used in the art, and some practical guidelines as to suggested dimensions of the rods, diameters of the rings, and spaced relation between ring members (from smallest ring member to the next and successively larger ring member).

TABLE 1

| Pastry bag size | Length of rods | Diameter of ring members | Spaced relation |
|---|---|---|---|
| 10" | 8¾" | 1½"/3"/5½" | 3⅛"/4½" |
| 16" | 12⅜" | 1½"/3"/5"/7½" | 3⅛"/4⅛"/5⅛" |
| 18" | 15½" | 1½"/4½"/6¾"/9" | 5¾"/4¾"/4½" |

Other constructions that embody the present invention may be apparent to those skilled in the art from the disclosures herein. For example, in another embodiment of the invention (not shown), the pastry bag supporting device may be fabricated in a one piece construction by bending and coiling a single rod of material having the desirable properties as disclosed above, such that upon completion the vertically elongated rod is in a corkscrew configuration. The pastry bag supporting device, thus formed, will also have a plurality of vertically spaced ring members in spaced relation to each other, wherein the ring members will, however, be open (i.e. not forming a complete and closed circle) and wherein the diameters of the ring members differ with respect to each other but correspond to the decreasing concentric dimensions of a pastry bag in forming a pattern of a cone to correspond to the shape of a pastry bag.

Figure 4:
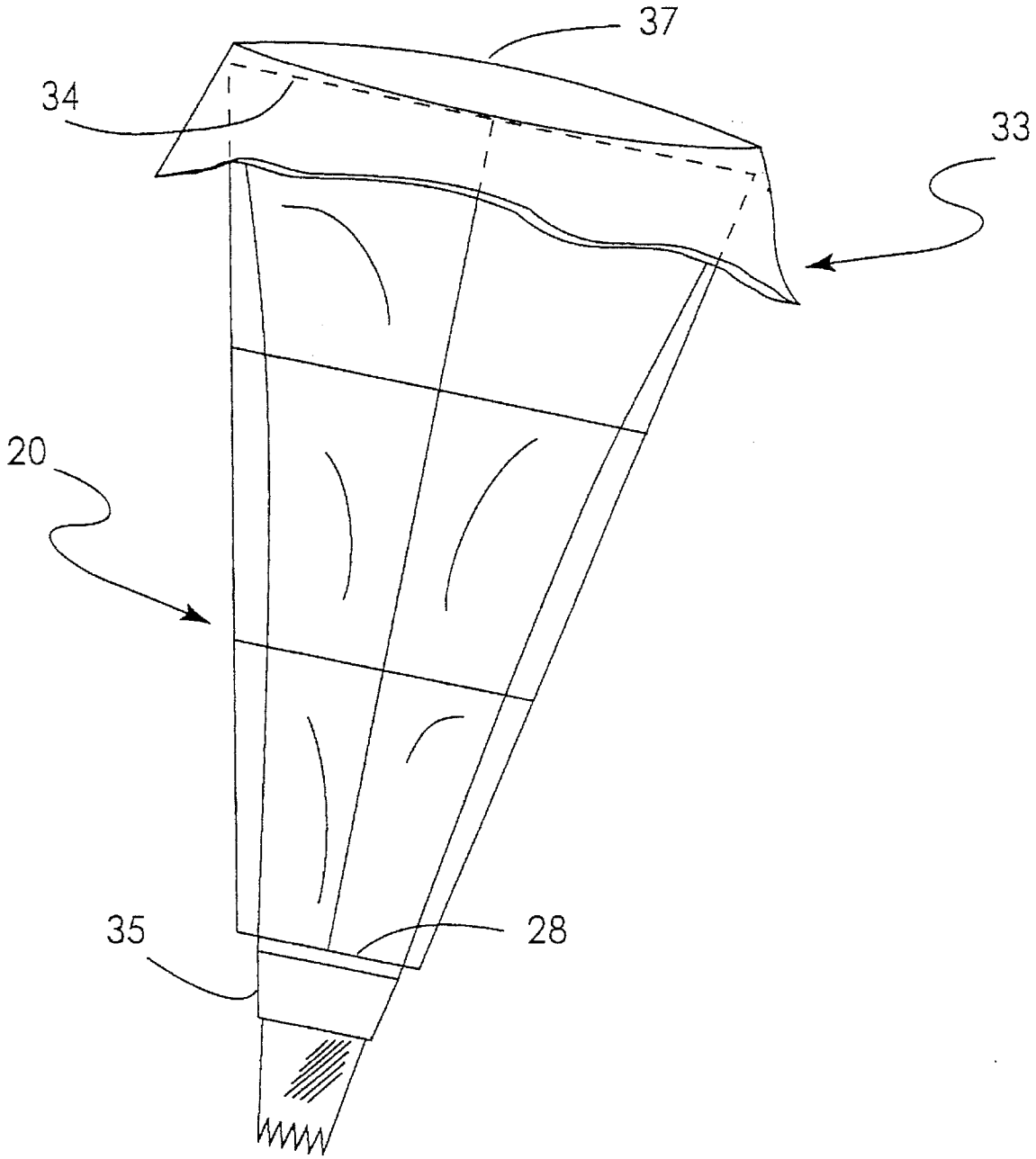
FIG. 4 is a side view showing a pastry bag positioned into the pastry bag supporting device.

The invention is also characterized as a method of supporting a pastry bag such as for maintaining the pastry bag in an open and fixed position for filling, cleaning and drying purposes; or in a closed upright position for storage purposes. In the method according to the present invention, and as illustrated in FIG. 4, pastry bag 33 is filled by placing it into pastry bag supporting device 20 until dispensing tip 35 of pastry bag 33 is snugly received by ring member 28. With dispensing tip 35 in place, a portion of pastry bag 33 at filling opening 37 may simply be folded over ring member 34 of pastry bag supporting device 20. Although folding of pastry bag 33 over ring member 34 may be sufficient to hold the bag in an open position for filling, it may be desirable to secure pastry bag 33 to ring member 34 by a clip means or other fastener means to ensure that the bag will not become dislodged in pastry bag supporting device 20 during the filling process.

In one embodiment of the method according to the present invention, the user holds pastry bag supporting device 20, having pastry bag 33 positioned therein, in one hand while the other hand is free to insert the foodstuff through filling opening 37 and into pastry bag 33. Such foodstuffs that may be inserted into a pastry bag using the method according to the present invention include, but are not limited to, whipped cream, cake icing, chocolate mousse, ricotta cheese, mashed potatoes, fruit fillings, and seafood mousse.

Figure 5:
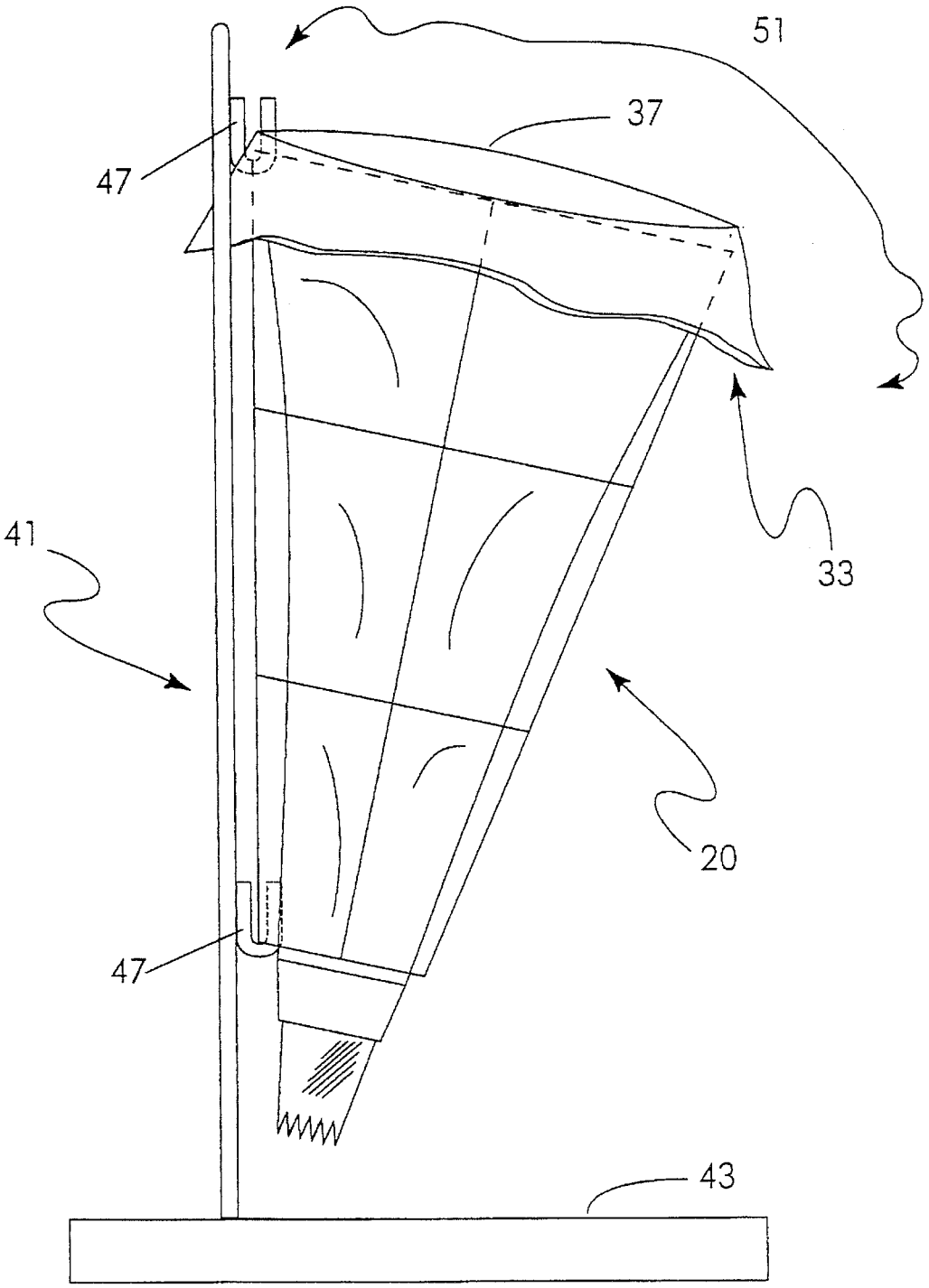
FIG. 5 is a side view of the pastry bag supporting device securely fastened to a support stand with bag in place.
Figure 6:
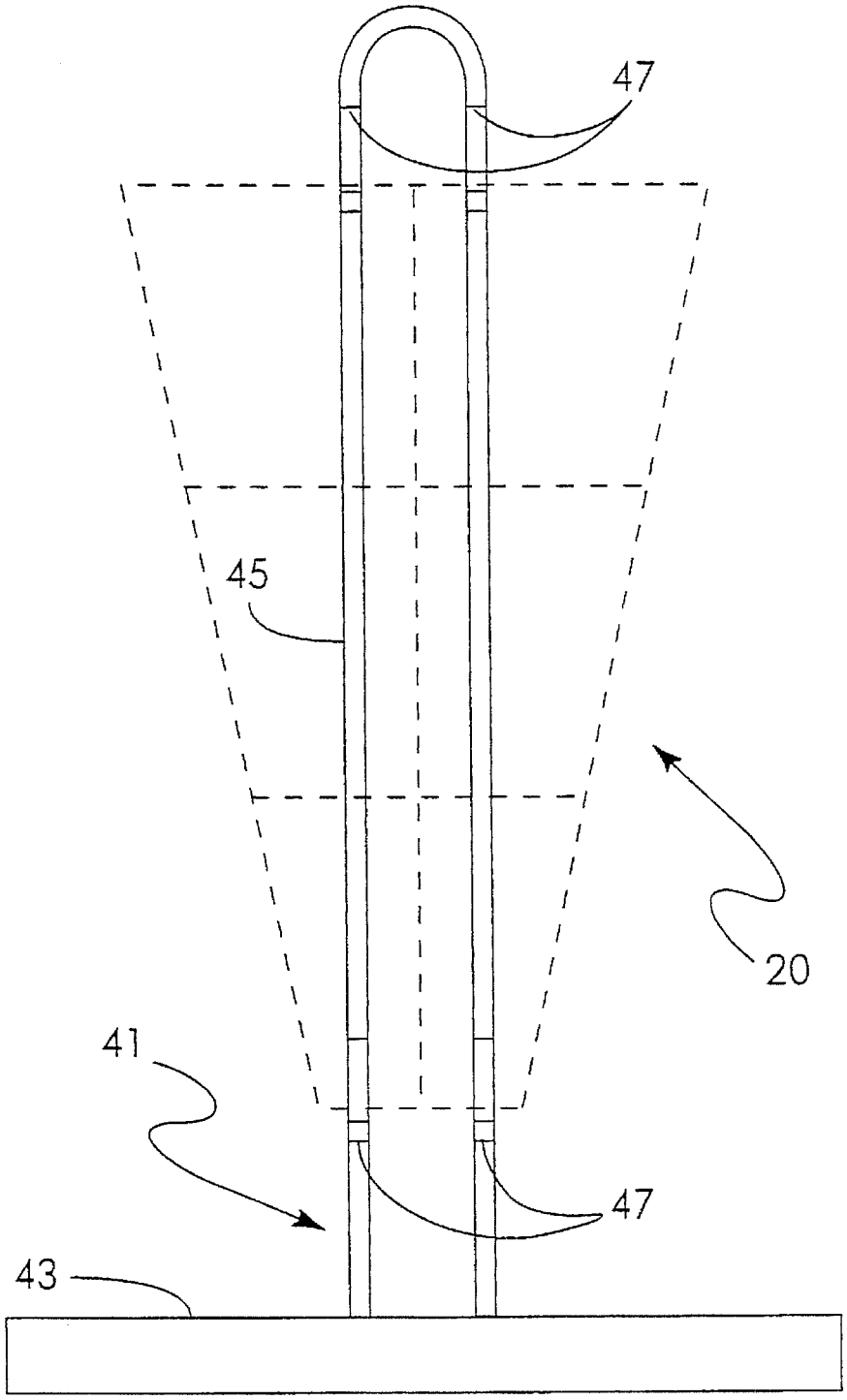
FIG. 6 is a frontal view of a support stand with the pastry bag supporting device shown in dashed outline as it is positioned to be securely fastened to the support stand.
Figure 7:
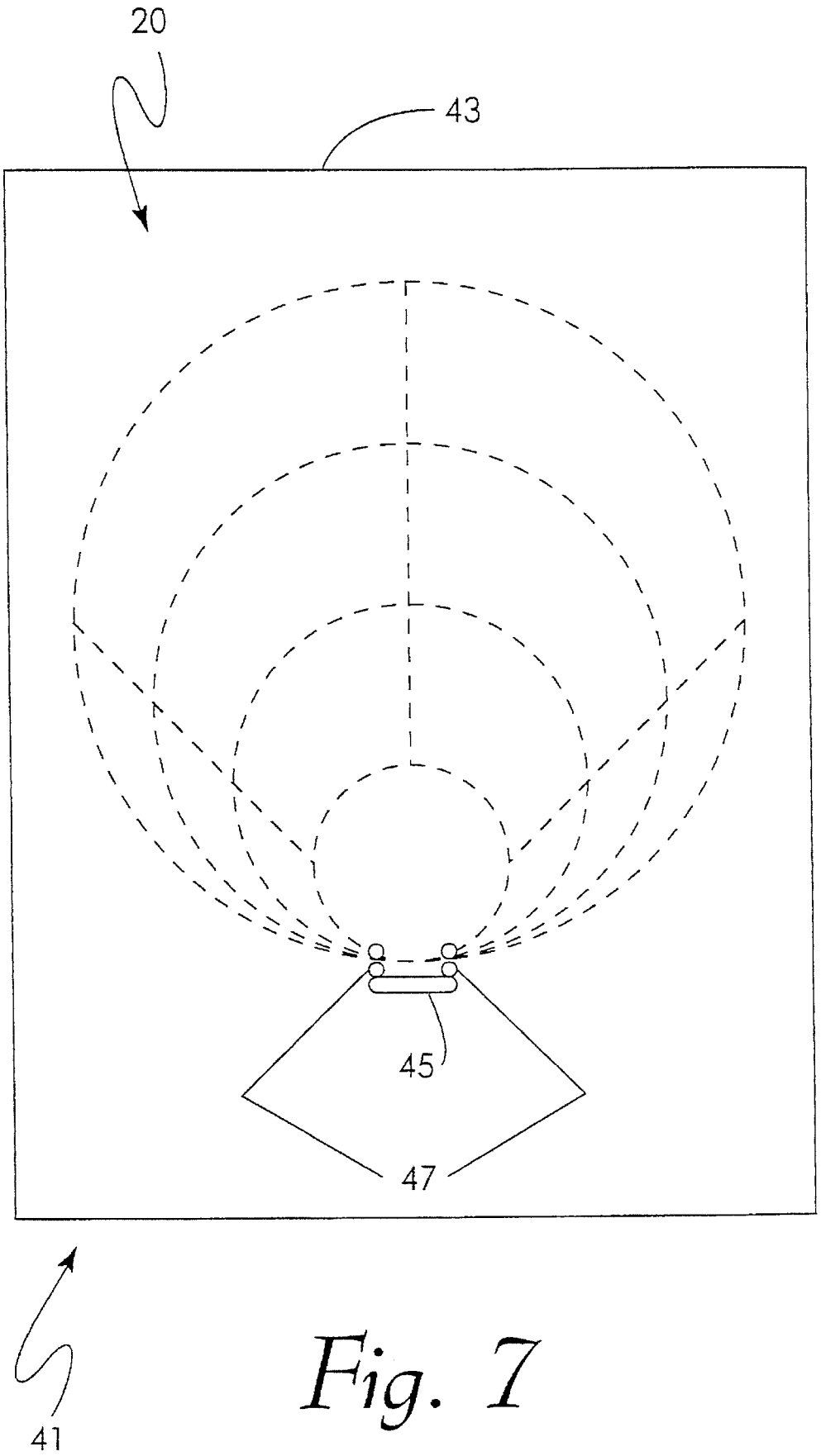
FIG. 7 is a top plan view of a support stand with the pastry bag supporting device shown in dashed outline as it is positioned to be securely fastened to the support stand.
Figure 8:
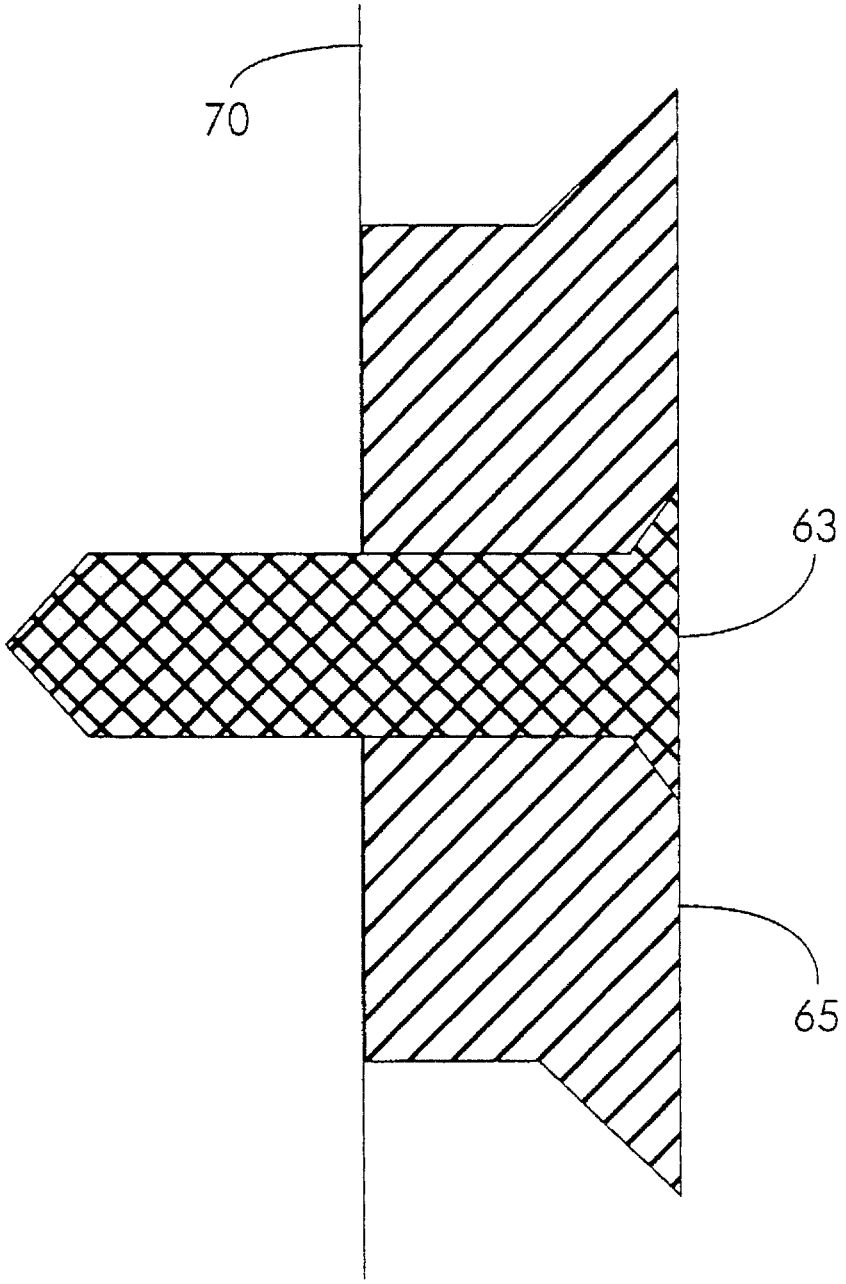
FIG. 8 is a cross-sectional view of the bar means, a component of the rack means, showing the bar means securably mounted to work surface.

In another embodiment of the method and assembly of accessories according to the present invention, and as illustrated in FIGS. 5–12, a support system, for supporting pastry bag supporting device 20 with or without a pastry bag positioned therewith, is used for filling pastry bag 33. As illustrated in FIGS. 5–7, one embodiment of a support system comprises support stand 41 comprising base means 43, vertical support means 45 connected to base means 43, and a plurality of hook means 47 to frictionally engage pastry bag supporting device 20, which are used together to securely hold in position pastry bag supporting device 20. Support stand 41 may be formed from resilient, corrosion-resistant, and easily cleaned materials such as plastic, stainless steel or the like which can be fabricated into a framework structure having the required structural integrity for the intended purpose and providing resistance to corrosion when cleaned by manual washing or in a conventional dishwasher. As the specific character of the material does not in and of itself constitute the subject matter of the instant invention as related to support stand 41, it should be apparent to those skilled in the art that a wide latitude of choice can be exercised in selecting a material suitable for its fabrication.

Once pastry bag supporting device 20 is securably fastened to support stand 41, such as via hook means 47, pastry bag 33 may be positioned in pastry bag supporting device 20 using the method described above (thereby forming assembly 51 comprising support stand 41, pastry bag 33, and pastry bag supporting device 20). Alternatively, assembly 51 may be formed by first positioning pastry bag 33 into pastry bag supporting device 20, and then pastry bag supporting device 20 containing pastry bag 33 may be positioned and secured in support stand 41. In either case, filling of pastry bag 33 with foodstuff may ensue.

It should be apparent to one skilled in the art from the description above, that assembly 51 may be stored in a cooler or refrigerator overnight to allow the user to continue use at a later time of the foodstuff contained in pastry bag 33.

As illustrated in FIGS. 8–12, another embodiment comprising a support system comprises a rack means 61 which can be securely fastened and mounted to work surface 70, such as a wall or the legs of a table, by fastener means 63 such as screws. Rack means 61 may be formed from resilient, corrosion-resistant, and easily cleaned materials such as plastic, stainless steel or the like which when fabricated, it has the required structural integrity for the intended purpose while providing resistance to corrosion when cleaned by manual washing. As the specific character of the material does not in and of itself constitute the subject matter of the instant invention as related to rack means 61, it should be apparent to those skilled in the art that a wide latitude of choice can be exercised in selecting a material suitable for its fabrication.

Figure 9:
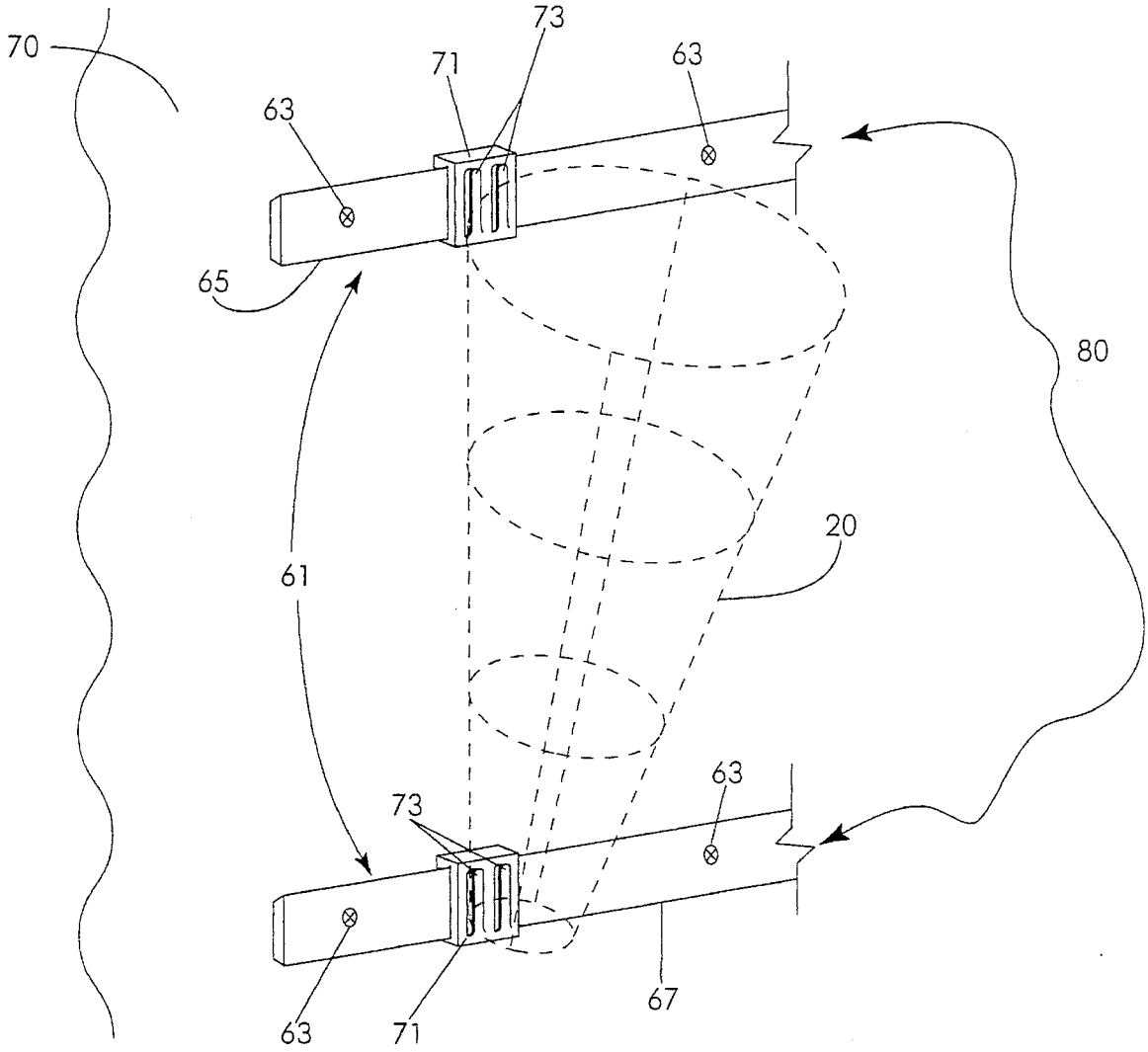
FIG. 9 is a side perspective view of a rack means with the pastry bag supporting device shown in dashed outline as it is positioned to be securely fastened to the rack means.
Figure 10:
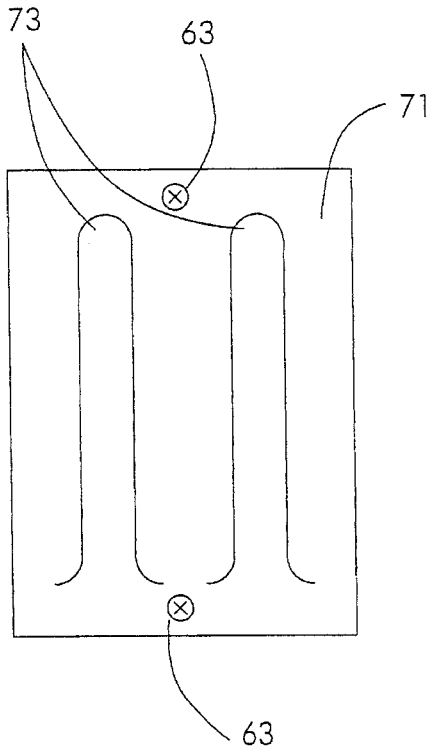
FIG. 10 is a frontal view of a bracket means, a component of the rack means.
Figure 11:
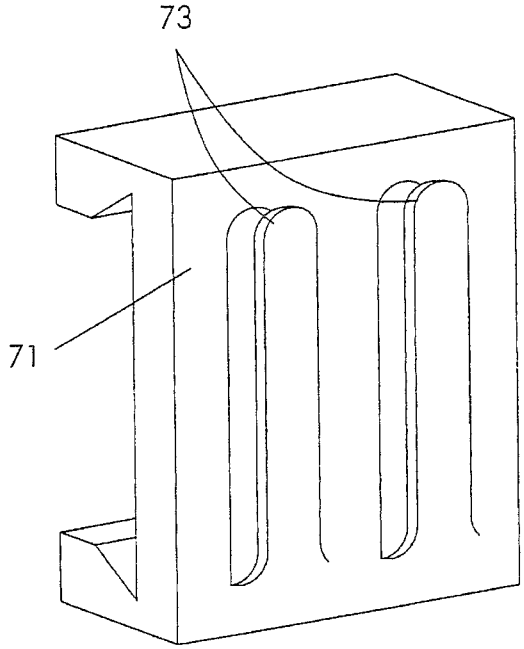
FIG. 11 is a perspective view of a bracket means, a component of the rack means.
Figure 12:
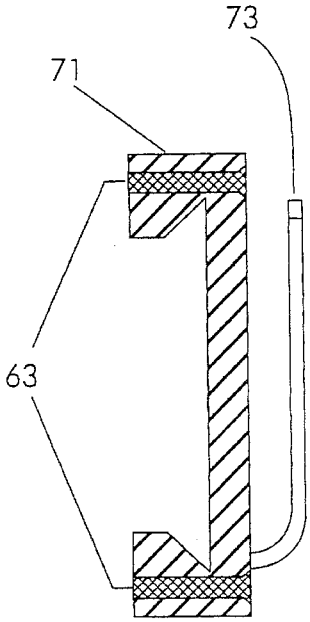
FIG. 12 is a side view of a bracket means, a component of the rack means.

In a preferred construction, rack means 61 comprises two substantially similar or identical bar means 65 and 67 that are fabricated so that they contain an upper and lower lip which together snugly receive a plurality of bracket means 71. Bracket means 71 are fabricated to contain a groove which is snugly received by, and in friction fit, with bar means 65 and 67. As for example illustrated in FIGS. 9–12, contained as part of bracket means 71, on the side opposite the groove, are a plurality of prong or hook means ("prong means 73"). As illustrated in FIG. 9, into prong means 73 snugly fits ring members of pastry bag supporting device 20, thereby securing pastry bag supporting device 20 and pastry bag 33 positioned therein (not shown), with rack means 61 in forming assembly 80. As described above and shown in FIGS. 8 and 9, bar means 65 and 67 may be securably mounted to work surface 70 by fastener means 63. As illustrated in FIGS. 10 and 11, bracket means 71 can also be securably mounted to work surface 70. Alternatively, and as illustrated in FIG. 9, bracket means 71 may remain unsecured to work surface 70 to allow bracket means 71 to be slidingly movable over the tracks of bar means 65 and 67.

Once pastry bag supporting device 20 is securably fastened to rack means 61, such as via bracket means 71, pastry bag 33 may be positioned in pastry bag supporting device 20. Alternatively, assembly 80 may be formed by first positioning pastry bag 33 into pastry bag supporting device 20, and then pastry bag supporting device 20 containing pastry bag 33 may be positioned and secured in rack means 61. In either case, filling of pastry bag 33 with foodstuff may ensue.

Figure 3:
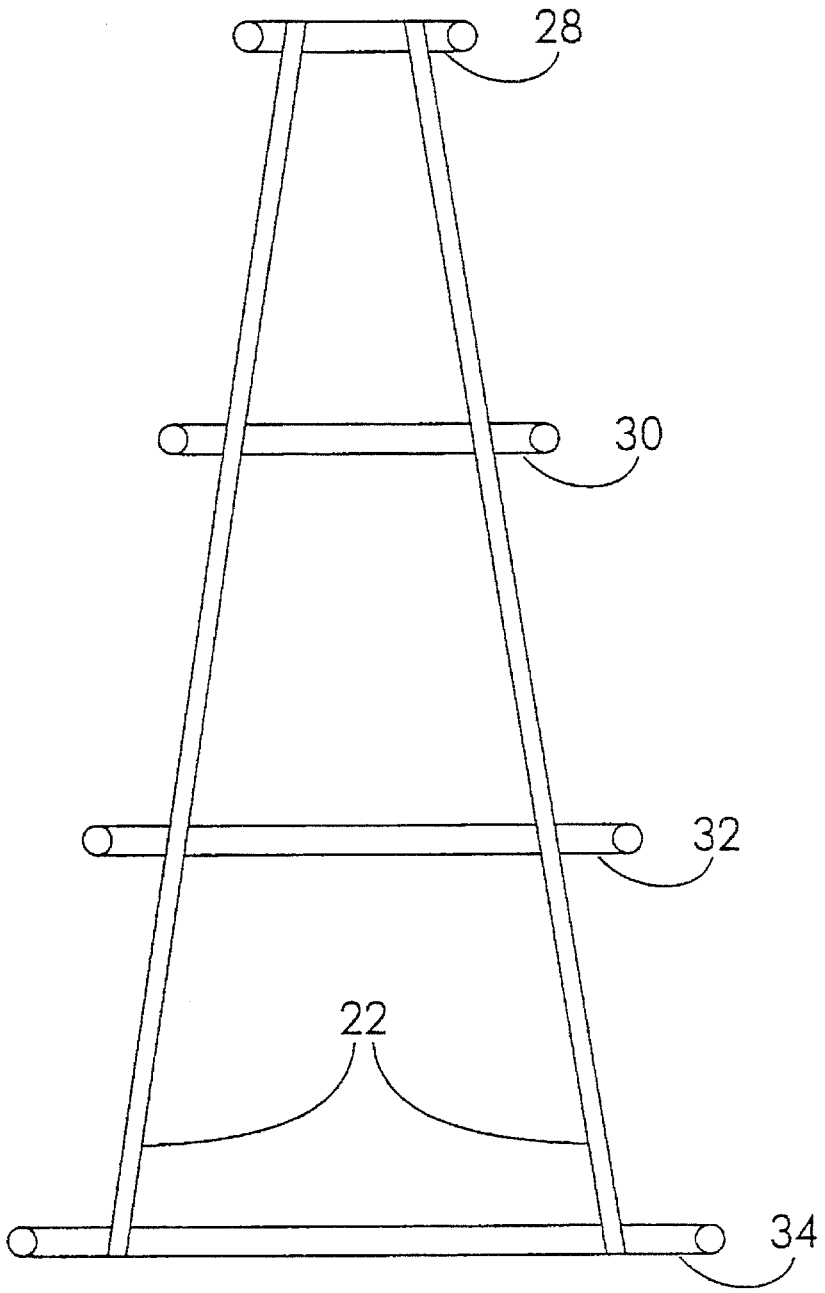
FIG. 3 is a side view in section taken on line 3—3 of FIG. 2 showing the ring members in vertically spaced relation.

In a method according to the present invention for supporting a pastry bag such as for maintaining the pastry bag in an open and fixed position for cleaning and drying purposes, pastry bag supporting device 20 is inverted, as illustrated in FIG. 3, so that the largest ring member, ring member 34 is in the lowest position as relative to the work surface or floor, and the smallest ring member, ring member 28 is spatially positioned vertically above the largest ring member. With pastry bag supporting device 20 positioned in such an inverted manner, pastry bag 33 can be slipped over (filling opening first) pastry bag supporting device 20 until the dispensing tip fits snugly over the smallest ring member, ring member 28, and such that the interior of pastry bag 33 is in contact with pastry bag supporting device 20.

With pastry bag 33 so positioned over pastry bag supporting device 20, pastry bag supporting device 20 may be placed in a conventional dishwasher for cleaning of the foodstuffs from pastry bag 33. In that regard, it may be desirable to secure pastry bag 33 to ring members by a clip means or other fastener means to ensure that the bag will not become dislodged from pastry bag supporting device 20 during the washing process. After washing, pastry bag supporting device 20, slipped over which is cleaned pastry bag 33, may be removed from the conventional dishwasher and placed, in inverted position, on a counter top to facilitate air-drying of pastry bag 33. Alternatively, once pastry bag supporting device 20 is removed from the conventional dishwasher or after manual washing, pastry bag supporting device 20 may be securely fastened to either support stand 41 or rack means 61 to facilitate either drying or storage of pastry bag 33.

It should be understood that while the present invention has been described in detail herein, the invention can be embodied through alterations and modifications by those skilled in the art without departing from the principles thereof. For example, a cap means may be transiently fastened to ring member 28 so that when filling pastry bag 33, foodstuff will be prevented from leaking out onto the work surface by the cap means. In another modification, an electric blower unit may be attached as part of support stand 41 to facilitate drying of pastry bag 33 subsequent to washing. Such embodiments are meant to come within the scope of the present invention as defined by the appended claims.

I claim:

1. A supporting device for a pastry bag having a filling opening and a dispensing tip comprising at least one vertically elongated rod having a plurality of vertically spaced ring members in spaced relation to each other, wherein the diameters of said ring members differ with respect to each other and correspond to the decreasing concentric dimensions of a pastry bag in forming a pattern of a cone adapted to correspond to the shape of a pastry bag and to snugly receive said pastry bag.

2. The pastry bag supporting device according to claim 1, wherein the pastry bag supporting device is comprised of resilient, corrosion-resistant, and easily cleaned material selected from the group consisting of plastic, stainless steel wire, metal wire, and nylon rod.

3. The pastry bag supporting device according to claim 2, wherein the pastry bag supporting device is free from burrs and sharp edges to avoid snagging of a pastry bag in providing for smooth transition of said bag when slipped into or over the pastry bag supporting device.

4. The pastry bag supporting device according to claim 1, wherein said at least one vertically elongated rod is a plurality of vertically extending rods having upper ends and lower ends positioned in spaced relation to form a tapered structure in the pattern of a cone to correspond to the shape of a pastry bag; and said plurality of vertically spaced ring members hold the rods in spaced relation, wherein said ring members have diameters which decrease with respect to each other so that the ring member having the largest diameter is located proximal to the upper ends of said rods and the ring member having the smallest diameter is located proximal to the lower ends of said rods.

5. An assembly comprising the pastry bag supporting device according to claim 1, a pastry bag positioned therewith, and a support system, wherein the support system is selected from the group consisting of a support stand and a rack means.

6. The assembly according to claim 5, wherein the support system is a support stand comprising a base means, a vertical support means connected to said base means, and a plurality of hook means which together function to frictionally engage, and securely hold in position, said pastry bag supporting device.

7. The assembly according to claim 6, wherein the support stand is comprised of resilient, corrosion-resistant, and easily cleaned material selected from the group consisting of plastic, stainless steel, and nylon.

8. A method for filling a pastry bag comprising using the assembly according to claim 6, wherein said pastry bag is in a fixed and open position inside said pastry bag supporting device with the dispensing tip of said bag snugly received by the smallest ring member of said pastry bag supporting device, and the filling opening of said bag folded over a larger ring member of said pastry bag supporting device; and inserting foodstuff through the filling opening and into said bag.

9. The assembly according to claim 5, wherein the support system is a rack means comprising two substantially similar bar means that are fabricated so that they contain an upper and lower lip in forming tracks which snugly receive a plurality of bracket means;

a plurality of bracket means, said bracket means are fabricated to contain a groove which is snugly received by tracks of, and in friction fit with, said bar means; and said bracket means and said bar means function together to securely hold in position said pastry bag supporting device, and pastry bag positioned therewith, in forming the assembly.

10. The assembly according to claim 9, wherein the rack means is comprised of resilient, corrosion-resistant, and easily cleaned material selected from the group consisting of plastic, stainless steel, and nylon.

11. The assembly according to claim 9, wherein the bracket means have a plurality of prong means into which snugly fits ring members of said pastry bag supporting device thereby securing pastry bag supporting device, and pastry bag positioned therewith with said rack means in forming the assembly.

12. The assembly according to claim 9, wherein said bar means are securably mounted to a work surface by fastener means.

13. The assembly according to claim 9, wherein said bracket means are securably mounted to a work surface by fastener means.

14. The assembly according to claim 9, wherein said bracket means remain unsecured to a work surface to allow bracket means to be slidingly movable over the tracks of said bar means.

15. A method for filling a pastry bag comprising using the assembly according to claim 9, wherein said pastry bag is in a fixed and open position inside said pastry bag supporting device with dispensing tip of said bag snugly received by the smallest ring member of said pastry bag supporting device, and filling opening of said bag folded over a larger ring member of said pastry bag supporting device; and inserting foodstuff through the filling opening and into said bag.

16. A method for filling a pastry bag using the pastry bag supporting device according to claim 1, said method comprising:

(a) placing said bag into said pastry bag supporting device until the dispensing tip of said bag is snugly received by the smallest ring member of said pastry bag supporting device; and (b) folding the filling opening of said bag over a larger ring member of said pastry bag supporting device resulting in said bag being in a fixed and open position; and (c) inserting foodstuff through the filling opening and into said bag.

17. The method according to claim 16, further comprising using fastener means to secure in a fixed and open position the filling opening of said pastry bag to said larger ring member.

18. The method according to claim 16, wherein a user holds the pastry bag supporting device, having said pastry bag positioned therein, with one hand while the other hand is used to insert the foodstuff through said filling opening.

19. A method for supporting a pastry bag and maintaining said bag in an open and fixed position for cleaning and drying purposes with the supporting device according to claim 1, said method comprising:

(a) inverting the pastry bag supporting device so that the largest ring member is in the lowest position as relative to a work surface, and the smallest ring member is spatially positioned vertically above the largest ring member; and (b) slipping a pastry bag, the filling opening of said pastry bag first, over said pastry bag supporting device until the dispensing tip of said bag fits snugly over the smallest ring member, and such that the interior of said pastry bag is in contact with said pastry bag supporting device.

20. The method according to claim 19, further comprising placing said pastry bag supporting device, having said bag positioned thereon, in a conventional dishwasher for cleaning of the foodstuffs from said pastry bag.

21. The method according to claim 20, wherein said pastry bag is secured to said ring members by fastener means to ensure that the bag will not become dislodged from said pastry bag supporting device during a washing process.

22. The method according to claim 20, further comprising removing the pastry bag supporting device, having a cleaned pastry bag positioned thereon, from the conventional dishwasher; and placing said pastry bag supporting device in an inverted position on a work surface to facilitate air-drying of said pastry bag.

23. The method according to claim 20, further comprising removing the pastry bag supporting device, having a cleaned pastry bag positioned thereon, from the conventional dishwasher; and securely fastening said pastry bag supporting device to a support system to facilitate drying or storage of said clean bag, wherein the support system is selected from the group consisting of a support stand and a rack means.

* * * * *